US006694523B2

(12) United States Patent
Hurst

(10) Patent No.: US 6,694,523 B2
(45) Date of Patent: Feb. 24, 2004

(54) ERGONOMIC COMPRESSION GLOVE FOR HAND, WRIST, THUMB AND FOREARM SUPPORT

(76) Inventor: Deborah Hurst, 1921 Oro Ct., Clearwater, FL (US) 33764

( * ) Notice: Subject to any disclaimer, the term of this patent is extended or adjusted under 35 U.S.C. 154(b) by 56 days.

(21) Appl. No.: 10/152,642

(22) Filed: May 21, 2002

(65) Prior Publication Data

US 2003/0217404 A1 Nov. 27, 2003

(51) Int. Cl.[7] ..... A41D 19/00

(52) U.S. Cl. ..... 2/161.7; 2/DIG. 3; 602/13; 602/21

(58) Field of Search ..... 2/161.6, 160, DIG. 3, 2/16, 161.1; 128/878, 879, DIG. 20; 602/13, 20, 21; 601/15, 151, 152

(56) References Cited

U.S. PATENT DOCUMENTS

| | | | | | |
|---|---|---|---|---|---|
| 2,792,827 | A | | 5/1957 | Gravin et al. | |
| 3,869,594 | A | | 3/1975 | Shively | |
| 4,173,218 | A | | 11/1979 | Cronin | |
| 4,281,647 | A | * | 8/1981 | Antypas | 602/21 |
| 4,522,197 | A | * | 6/1985 | Hasegawa | 601/40 |
| 4,706,658 | A | | 11/1987 | Cronin | |
| 4,846,160 | A | | 7/1989 | Gardner et al. | |
| 5,035,003 | A | | 7/1991 | Rinehart | |
| 5,297,541 | A | | 3/1994 | Hensey | |
| 5,369,807 | A | | 12/1994 | Cho et al. | |
| 5,603,118 | A | * | 2/1997 | Solomon | 2/20 |
| 5,997,495 | A | * | 12/1999 | Cook et al. | 602/62 |
| 6,146,347 | A | * | 11/2000 | Porrata | 602/21 |
| 6,146,413 | A | | 11/2000 | Harman | |
| 6,199,211 | B1 | | 3/2001 | Franzolino | |

* cited by examiner

*Primary Examiner*—Katherine Moran
(74) *Attorney, Agent, or Firm*—Dennis G. LaPointe; Mason Law, P.A.

(57) ABSTRACT

The specification and drawings describe and show one or more embodiments of the present invention in the form of a compression glove for selective application for treatment of hand, wrist, forearm and thumb discomfort. Useful for prevention and relief of injuries caused by repetitive motions while handling implements, it has a flexible waterproof glove body with exposed fingertips. The glove includes a pair or series of layers of hermetically sealed material, that can capture pressurized air, when applied therein. It is formed through the patterned sealing of the layers of the glove together at select locations. This forms inflatable chambers that can selectively apply isolated points of pressure and support to the affected area.

12 Claims, 5 Drawing Sheets

ERGONOMIC COMPRESSION GLOVE FOR HAND, WRIST, THUMB AND FOREARM SUPPORT

The invention relates to relates to a therapeutic glove for the hand, thumb, wrist and forearm of a person suffering from repetitive motion injuries such as Carpal Tunnel Syndrome, arthritis and related pain and swelling in the hands.

Supporters for hands and wrist are known in the art. However, most are designed for limited non-industrial purposes such as for sports, for example, batting gloves for baseball, bowling gloves, and golfing gloves. Many are designed with the primary purposes of enabling a better grip on the bat, ball, or club, thereby minimizing slippage when manipulating an object or implement such as a bat, handle or trigger assembly. Gloves used in industrial settings are primarily designed to avoid blisters, protect the hands from getting wet or getting contaminated such as when handling hazardous waste. Gloves used for medical purposes are designed for specific malady or address a specific segment of the area and are not meant to be worn during normal everyday activities.

None of the prior art devices known to this inventor solve the problems related to strain on the wrist and palms due to repetitive motions in an everyday real life setting, for example, washing of dishes or preparing a meal, playing in the pool with your youngster, cutting or processing a client's hair if you are a hairdresser. What is needed is a glove which will when going about our daily lives, working around the house or at a place of business, aid or prevent the weakening of the wrists and prevent tendon strains and soreness, including the development of tendonitis, in the inner palm and lower forearm. In addition, the current gloves on the market simply do not adequately protect or address the specific needs or physical issues caused by repetitive motion in everyday activities that involve getting one's hands wet or dirty. Even combining some of the features of the prior art gloves does not solve the problem adequately as the resultant glove would still not offer the freedom of movement and lightness, to be washable and submergible, and to offer the support and protection that the present invention provides.

Examples of everyday applications for the use of the present invention are hairdressers, cooks, dishwashers, assembly workers, mechanics, landscapers, gardening and agricultural work, that is, almost any application involving wrist and hand movements, especially long term repetitive motions.

The invention is a one-piece, generally fingerless glove with inflatable chambers around the wrist, thumb and palm. The chambers may be filled with air to apply pressure. Alternatively, they may be filled with warm or cold water, and/or contain magnets. Of course, combination of air, water and magnets may be utilized.

Wearing of the glove provides support and to some degree, limits range of motion, thus relieving pain. It is to be worn during the routine duties of life and especially during performance of the repetitive motions which caused the Carpal Tunnel Syndrome initially. The glove can be worn comfortably during the day, as well as while asleep. Unlike rigid wrist braces and supports that can not get wet, the inflatable glove makes it easy for someone who works with their hands in water or any substance to wear the glove and have the support they need.

The glove is preferably made of a stretchy latex or rubberized, form fitting material. The glove is designed or adapted such that when the chambers are filled, it will fit snugly, applying pressure/heat/cold/magnets to the afflicted areas of the hand, thumb and or wrist/forearm and allowing the wearer to submerge their hands in water while wearing.

The glove has open fingertips, which is also referred to as cut-off fingers, so that the wearer's sense of touch is not impaired and items can be grasped or picked up normally.

More specifically, the present invention is a compression thumb, wrist/forearm, and upper palm supporter which is useful for prevention of injuries caused by repetitive motions while handling implements in a wet or dry environment. It in effect is a flexible glove which has a finger portion and a wrist partial forearm portion.

The palm portion when inflated provides for a protective padded over an area corresponding to the palm area. The protective padded overlay is typically made from a durable, waterproof and flexible material like latex, rubber, synthetics thereof and combinations thereof The glove provides for a plurality of durable protective air chambers each of a predetermined width and length, and substantially parallel to each other and sufficiently spaced-apart to allow for restricted movement where desired while allowing for limited or free movement where desired, depending on the chamber pressures created. In addition, the chambers are capable of flexing for accommodating a hand grabbing an implement such as a handle, scissors, hose, tool, nozzle and the like.

A wrist and forearm protective portion extends from the proximal end of the glove body and is of sufficient length to extend a predetermined distance from the wrist along the forearm. The wrist and forearm protective chamber portion is adapted to allow a hand to be slipped into the glove, to accommodate a size and shape of the wrist and forearm covered by the glove, and to secure and apply pressure around the wrist and part of the forearm to which pressure is to be applied.

Inflating means are provided for each inflatable chamber. Such means using air or water are known in the art. They comprise applicable valves or ports for injecting air or water and for releasing such air or water. That is, the inflating means are operatively associated with the upper layer of the glove, there being one inflating device for each segment of internal pocket, to allow for injecting of pressurized air (or water) into each segment of the glove during usage. Each inflating device is capable of being manipulated to provide for release of the pressurized air (or water) from each segment of the glove after use.

In one embodiment, the essentially fingerless waterproof glove includes a pair or series of layers of hermetically sealed material, that can capture pressurized air or water, when applied therein. The chambers are formed through the patterned sealing of the layers of the glove together at select locations, to form air pockets that can selectively apply isolated points of pressure to the affected area of the hand and wrist/forearm section of the person. The palm portion and back portion of the glove body are joined together so as to define respective openings for receiving a forefinger, a a little finger, a middle finger, and an index finger, as well as an opening for receiving a thumb. The glove is design cut to apply encompassing pressure over the entire affected area, and includes inflating means that can allow for the injection of measurable air (or water), to the desired pressure points, or its deflation, after use. The glove consist of 3 air chambers, the thumb chamber, the wrist chamber and the palm chamber. The compression glove body can be made from a variety of materials; however, a preferred application of the invention would use material that can be gotten wet and dried easily such as latex, rubber, nylon material, synthetics thereof, or combinations thereof These materials are lightweight, non-restrictive, water friendly and washable for addressing hygienic and environmental concerns.

Although the inventive glove can be custom made in various sizes to fit different size hands, once inflated, the glove would typically be removable by stretching the elastomeric material. The inflating means would typically be used to temporarily deflate the chambers, which would then allow for the easy removal of the glove from a person's hand.

All air chambers for the thumb, palm, and wrist portions can be hermetically sealed in a preferred application of the invention; however, there may be other means known in the art such as by using adhesives to affix such components.

For a fuller understanding of the nature and objects of the invention, reference should be made to the following detailed description, taken in connection with the accompanying drawings, in which.

Figure 1:
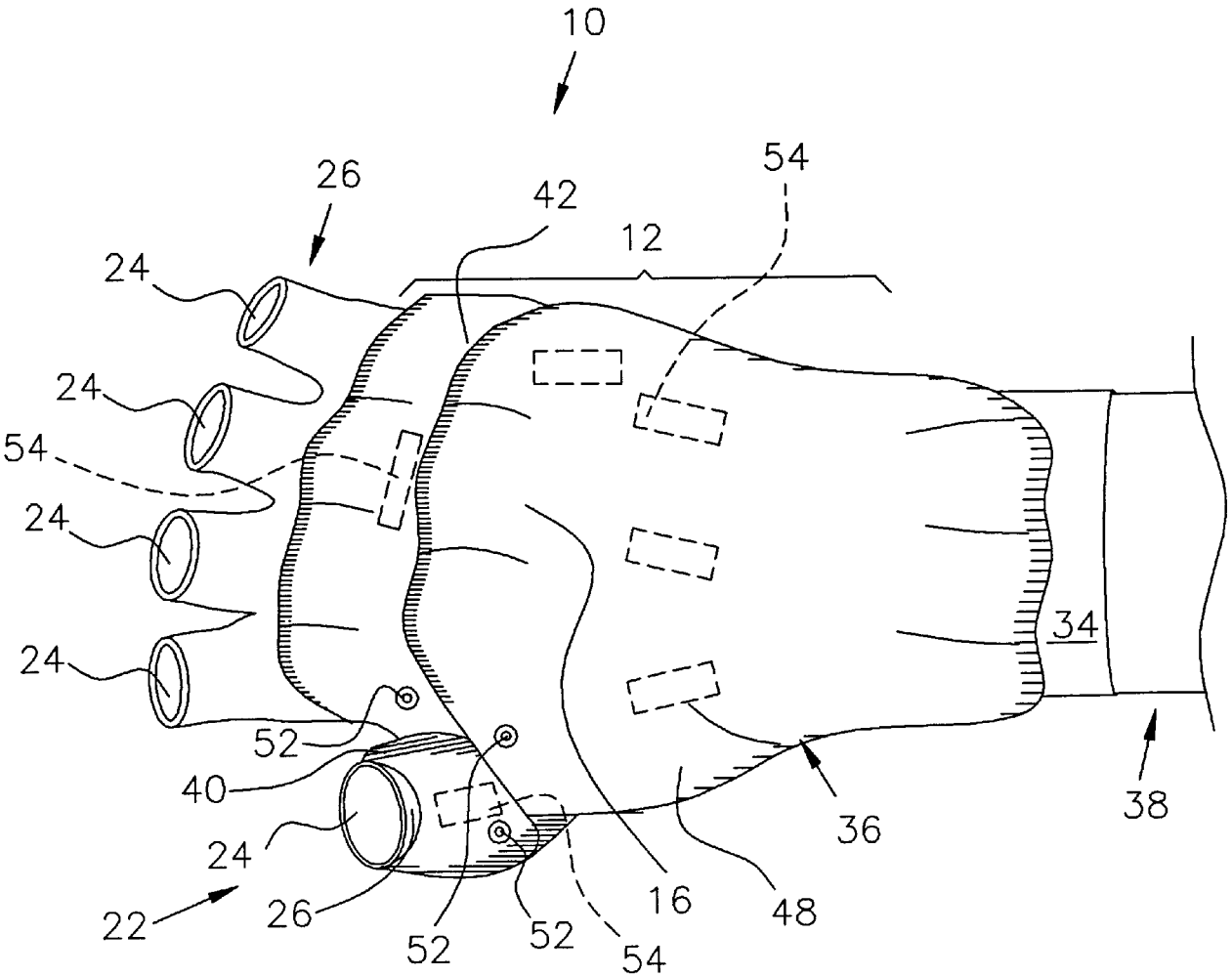
FIG. 1 is a perspective plan view of the invention.
Figure 2:
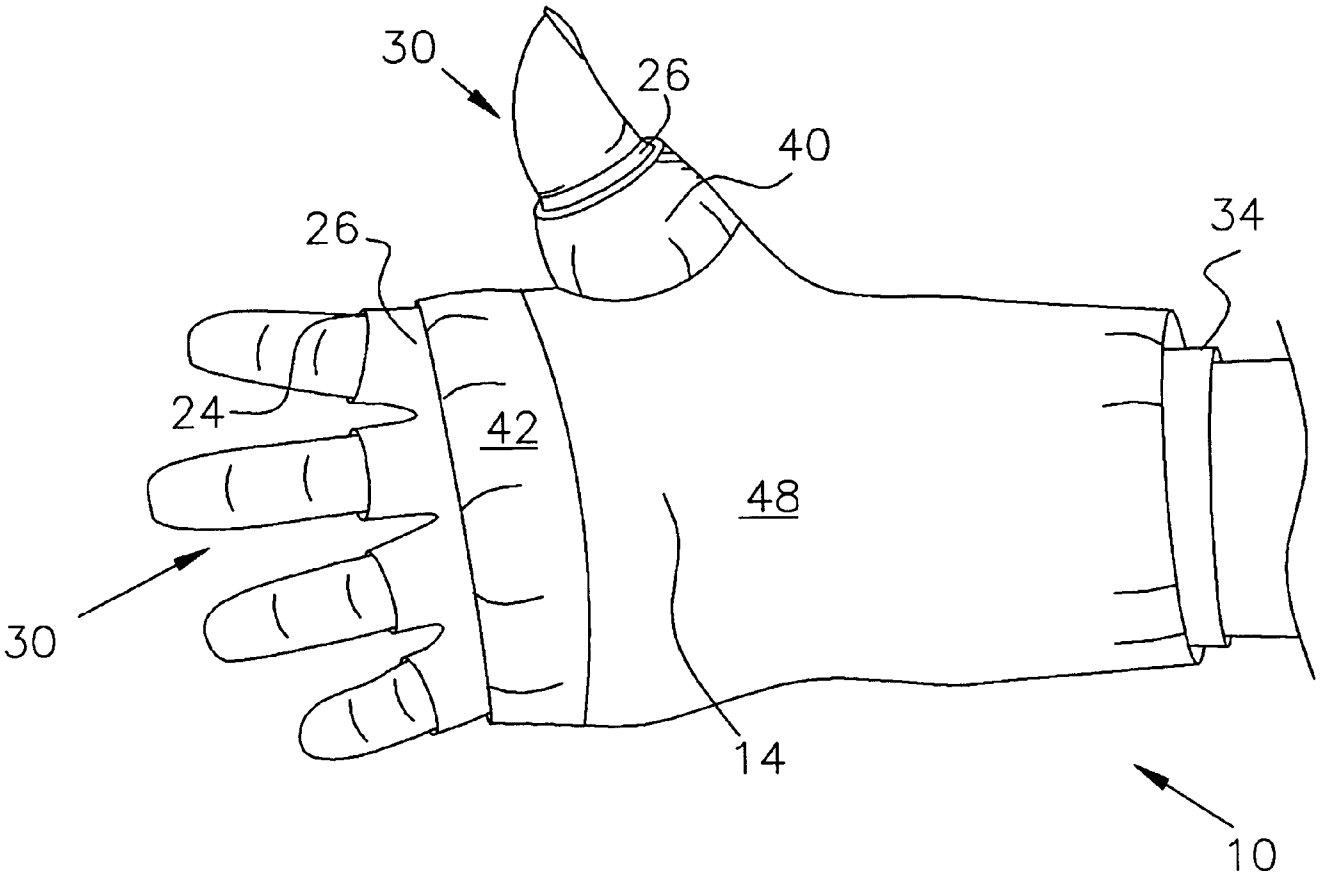
FIG. 2 is a palm side view of the invention.
Figure 3:
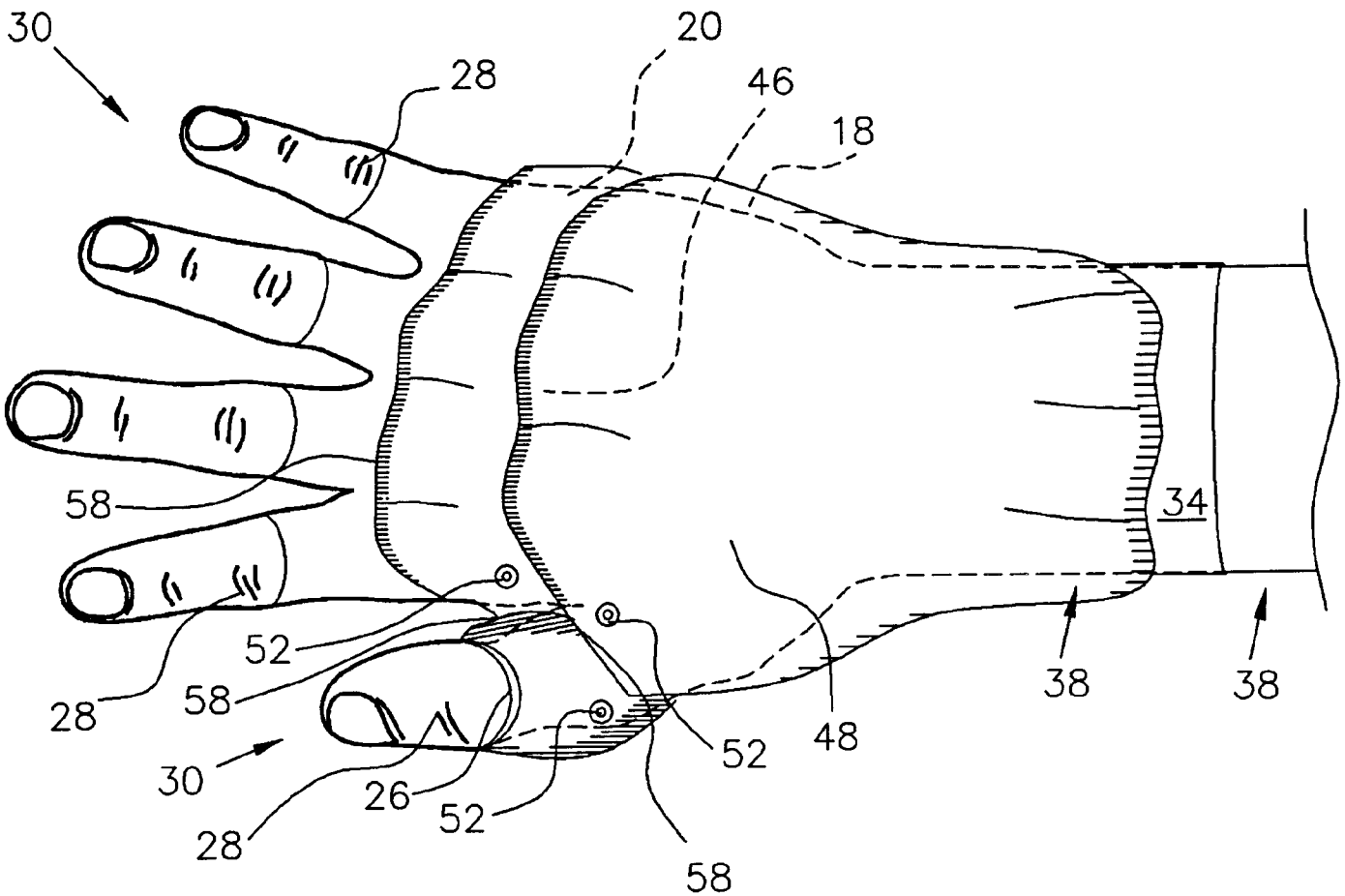
FIG. 3 is a back side view of the invention being worn and in an inflated state.

Referring now to the drawings, FIGS. 1–4 disclose various typical embodiments of the present invention, which is an ergonomic glove for hand, wrist, thumb and forearm support useful for persons suffering from repetitive motion injuries such as Carpal Tunnel Syndrome, arthritis and related pain and swelling in the hands, and is depicted generally as 10.

Figure 5:
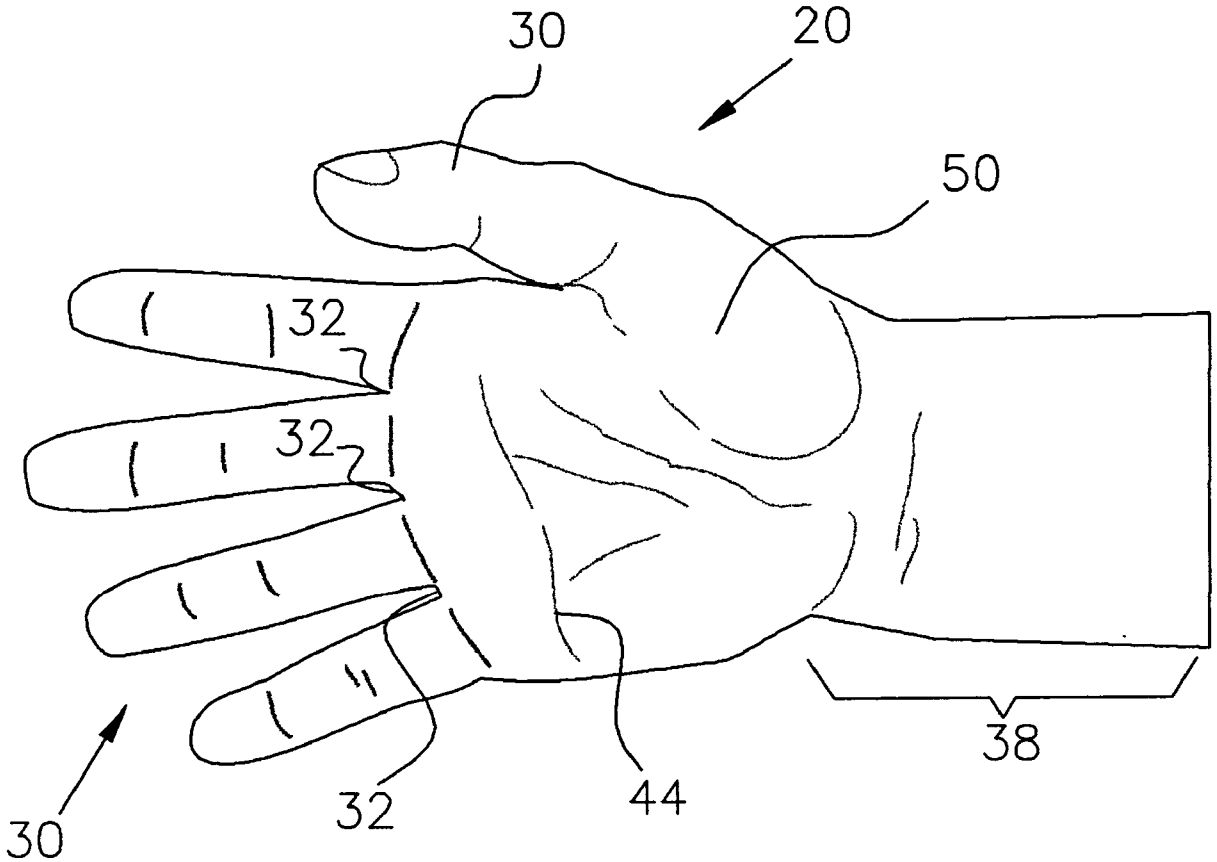
FIG. 5 is a view of a hand for reference use in reading the specifications herein.

The invention has a flexible main glove body 12 including a palm portion 14 and a back portion 16 which define an open space 18 for receiving a hand 20 (see FIG. 5 for reference in reading the specifications) at a proximal end 36 of said main glove body 12. The palm portion 14 and the back portion 16 are adapted at a distal end 22 of the main glove body 12 to form corresponding openings 24 for each finger 30 of a person's hand 20, including the thumb.

Finger and thumb covering portions 26 are included, which extend from the finger and thumb corresponding openings 24 at the distal end 22 of the main glove body 12. Each finger and thumb covering portion 26 is adapted to fit over an area extending to near a knuckle 28 of each finger and thumb 30 closest to a base 32 of each corresponding finger and thumb 30 of the person wearing the ergonomic glove 10.

A wrist covering portion 34 extends from the proximal end 36 of the main glove body 12 a predetermined distance for covering a wrist and a section of a forearm (collectively 38) of the person. The thumb covering portion 26 has a first inflatable chamber 40 surrounding said thumb covering portion 26. A second inflatable chamber 42 is formed so as to surround the palm portion 14 and the back portion 16 of the main glove body 12 and to cover an area in the palm portion 14 approximately between the distal end 22 of the main glove body 12 to about a break point 44 of the inside palm of the person's hand and further formed to extend around the main glove body 12 to the back portion 16 and to extend from approximately the distal end 22 of the main glove body 12 to approximately a center 46 of the back of the person's hand.

A third inflatable chamber 48 is formed so as to surround a lower portion 50 of the palm portion 14 and back portion 16 of the main glove body 12 and to extend a predetermined distance over at least a portion of the wrist covering portion 34 and surrounding said wrist covering portion 34 over the extended distance. The first, second and third inflatable chambers 40,42,48 define inflatable pockets independent from one another.

The invention 10 further includes inflating means 52 for selectively inflating each of the first, second and third inflatable chambers 40,42,48.

In one preferred embodiment, the ergonomic glove 10 is made from a water-repellent material such as latex rubber material, other elastomeric material, synthetic material of said latex rubber material and elastomeric material and combinations thereof.

Figure 4:
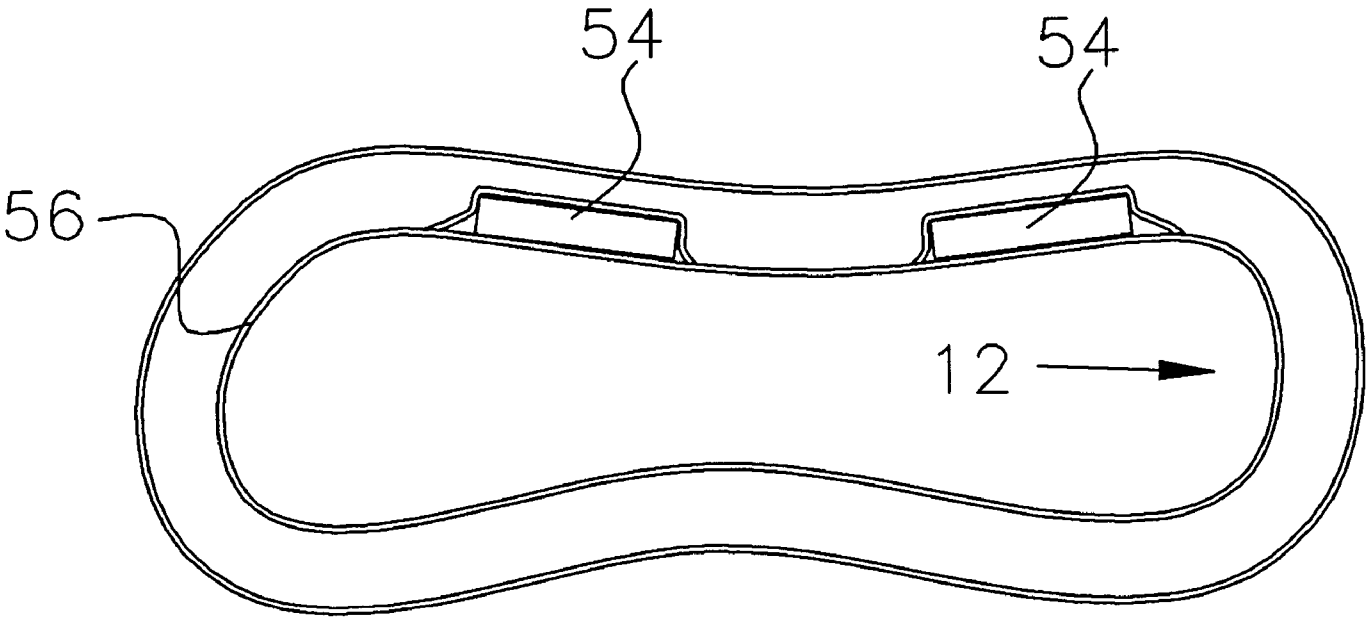
FIG. 4 is a conceptual partial cross-section view of one of the chambers depicting magnets attached to the layer of the chamber closest the hand surface.

In another embodiment of the invention, the ergonomic glove 10 incorporates one or more flexible magnets 54 in selected locations within one of the first inflatable chamber 40, the second inflatable chamber 42, the third inflatable chamber 48 and combinations thereof As shown in FIG. 4, the magnets 54 would be typically attached by such methods as adhesive to the inside surface 56 of the inflatable chambers, typically one or both of the second and third inflatable chambers (42,48), on the layer of the chamber closest the hand surface. Smaller magnets 54 may be included in the first inflatable chamber 40 which surrounds the thumb portion. In addition, these magnets 54 are typically located in the back portion 16 of the main glove body 12. One single or a plurality of magnets may be used.

Each inflating means 52 for each of the first, second and third inflatable chambers 40,42,48 is capable of individually inflating and deflating each of the chambers with one of air and water. Although the embodiment using air pressure may at first be anticipated to be the most popular, the therapeutic effect of warm water or cold water may also be very popular with arthritic people. In either case, the inflating means 52 are preferably designed to be capable of individually inflating and deflating each of the chambers with air or alternatively, with water.

A corresponding boundary 58 for each inflatable chamber 40,42,48 is sealed so that when inflated, a pressure can be maintained, which is applied to affected areas of one of the person's thumb, hand, wrist, forearm and combinations thereof.

The first inflatable chamber 40 is designed so that when it is inflated, it will restrict mobility of the thumb while at the same time cushioning the thumb. Similarly, the third inflatable chamber 48 is designed so that when it is inflated, it will restrict mobility of the person's wrist. The second inflatable chamber 42 is designed so that when it is inflated, it will not interfere with the mobility of the person's fingers.

The finger and thumb covering portions 26 define a snug fit around the individual fingers and thumb 30. As mentioned above, the compression glove 10 is essentially fingerless, that is, the fingertips are "cut-off," a term generally used in the glove industry. Therefore, the snug fit ends approximately one inch above the distal end 22 of the main glove body 12 and continues in a generally longitudinal direction to provide a snug fit around the base portion of each finger and thumb 30, except for the portion of the thumb around which the first inflatable chamber 40 encases.

As seen from the foregoing description, the present invention satisfies a long felt need to provide an ergonomic compression glove that can be worn where long term repetitive motions using tools, scissors, nozzles, and other implements can cause injury, thereby lowering production overhead costs due to lost services of employees, and lowering insurance costs.

It should be understood that the preceding is merely a detailed description of one or more embodiments of this invention and that numerous changes to the disclosed embodiments can be made in accordance with the disclosure herein without departing from the spirit and scope of the invention. The preceding description, therefore, is not meant to limit the scope of the invention. Rather, the scope of the invention is to be determined only by the appended claims and their equivalents.

Now that the invention has been described,

What is claimed is:

1. An ergonomic glove for hand, wrist, thumb and forearm support useful for persons suffering from repetitive motion injuries such as Carpal Tunnel Syndrome, arthritis and related pain and swelling in the hands comprising:

a flexible main glove body having a palm portion and a back portion defining an open space for receiving a hand at a proximal end of said main glove body;

the palm portion and the back portion being adapted at a distal end of the main glove body to form corresponding openings for each finger of a person's hand, including the thumb;

finger and thumb covering portions extending from the finger and thumb corresponding openings at the distal end of the main glove body, each finger and thumb covering portion being adapted to fit over an area extending to near a knuckle of each finger and thumb closest to a base of each corresponding finger and thumb of the person wearing the ergonomic glove;

a wrist covering portion extending from the proximal end of the main glove body a predetermined distance for covering a wrist and a section of a forearm of the person;

the thumb covering portion having a first inflatable chamber surrounding said thumb covering portion;

a second inflatable chamber formed so as to surround the palm portion and the back portion of the main glove body and to cover an area in the palm portion approximately between the distal end of the main glove body to about a break point of the inside palm of the person's hand and further formed to extend around the main glove body to the back portion and to extend from approximately the distal end of the main glove body to approximately a center of the back of the person's hand;

a third inflatable chamber formed so as to surround a lower portion of the palm portion and back portion of the main glove body and to extend a predetermined distance over at least a portion of the wrist covering portion and surrounding said wrist covering portion over the extended distance;

the first, second and third inflatable chambers defining inflatable pockets independent from one another; and inflating means for selectively inflating each of the first, second and third inflatable chambers.

2. The ergonomic glove according to claim 1, wherein the glove is made from a water-repellent material.

3. The ergonomic glove according to claim 2, wherein the water-repellent material is one of latex rubber material, elastomeric material, synthetic material of said latex rubber material and elastomeric material and combinations thereof.

4. The ergonomic glove according to claim 1, further comprising one or more flexible magnets in selected locations within one of the first inflatable chamber, the second inflatable chamber, the third inflatable chamber and combinations thereof.

5. The ergonomic glove according to claim 1, wherein each inflating means for each of the first, second and third inflatable chambers is capable of individually inflating and deflating each of the chambers with one of air and water.

6. The ergonomic glove according to claim 1, wherein each inflating means for each of the first, second and third inflatable chambers is capable of individually inflating and deflating each of the chambers with air.

7. The ergonomic glove according to claim 1, wherein each inflating means for each of the first, second and third inflatable chambers is capable of individually inflating and deflating each of the chambers with water.

8. The ergonomic glove according to claim 1, wherein a corresponding boundary for each inflatable chamber is sealed so that when inflated, a pressure can be maintained, which is applied to affected areas of one of the person's thumb, hand, wrist, forearm and combinations thereof.

9. The ergonomic glove according to claim 1, wherein the first inflatable chamber can be inflated so as to restrict mobility of the thumb while cushioning said thumb.

10. The ergonomic glove according to claim 1, wherein the third inflatable chamber can be inflated so as to restrict mobility of the person's wrist.

11. The ergonomic glove according to claim 1, wherein the second inflatable chamber can be inflated so as not to interfere with the mobility of the person's fingers.

12. The ergonomic glove according to claim 4, wherein the flexible magnets are attached at the selected locations to an inside surface of each respective inflatable chamber which is closest the person's thumb, hand, wrist or forearm.

* * * * *